US005385702A

United States Patent [19]

Mills et al.

[11] Patent Number: 5,385,702

[45] Date of Patent: Jan. 31, 1995

[54] METHOD FOR STABLE RAPID SPINNING OF A POLYBENZOXAZOLE OR POLYBENZOTHIAZOLE FIBER

[75] Inventors: Michael E. Mills, Midland, Mich.; Yoshihiko Teramoto, Ohtsu, Japan; Timothy L. Faley, Midland, Mich.; Masaru Nakagawa, Ohtsu, Japan

[73] Assignee: The Dow Chemical Company, Midland, Mich.

[21] Appl. No.: 207,989

[22] Filed: Mar. 8, 1994

Related U.S. Application Data

[63] Continuation-in-part of Ser. No. 985,078, Dec. 3, 1992, Pat. No. 5,294,390.

[51] Int. Cl.[6] ..... D01D 5/04; D01F 6/26; D02G 3/02

[52] U.S. Cl. ..... 264/103; 264/205; 264/211.16; 528/183; 528/190; 528/193; 528/337

[58] Field of Search ..... 264/103, 205, 211.16, 264/211.12, 211.14, 211.16, 210.8, 233; 528/183, 190, 193, 337

[56] References Cited

U.S. PATENT DOCUMENTS

| | | | |
|---|---|---|---|
| 3,584,104 | 6/1971 | Bohrer et al. . | |
| 4,702,876 | 10/1987 | Ebregt et al. . | |
| 4,945,156 | 7/1990 | Jenekhe et al. . | |
| 5,174,940 | 12/1992 | Kumar et al. . | |
| 5,294,390 | 3/1994 | Rosenberg et al. | 264/103 |

FOREIGN PATENT DOCUMENTS

| | | |
|---|---|---|
| 284509 | 3/1990 | Japan . |
| 284510 | 3/1990 | Japan . |
| 284511 | 3/1990 | Japan . |
| 3104920 | 5/1991 | Japan . |
| 3104921 | 5/1991 | Japan . |
| 4194022 | 7/1992 | Japan . |

OTHER PUBLICATIONS

MRS, vol. 134, The Materials Science and Engineering of Rigid-Rod Polymers, "*An Integrated Laboratory Process For Preparing Rigid Rod Fibers From The Monomers*" Harvey D. Ledbette et al. pp. 253-264.

Encyclopedia of Polymer Science and Engineering, Second Edition, vol. 11, "*Polybenzothiazoles and Polybenzoxazoles*", *by James F. Wolfe, pp. 601-635.*

MRS Bulletin, Nov. 16/Dec. 31, 1987 "*High Performance Polymer Fibers*" W. Adams et al. p. 22.

Macromolecules, 1981, vol. 14, "*Synthesis. Spinning & Fiber Mechanical Properties of Poly (p-phenylenebenzobisoxazole)*" by E. Won Choe and Sang Nim Kim: pp. 920-924.

The following Pending U.S. patent application Ser. No. 984,828 (Attorney Docket No. 39,942); Ser. No. 985,060 (Attorney Docket No. C-40,087); Ser. No. 985,079 (Attorney Docket No. C-40,622); Ser. No. 985,080 (Attorney Docket No. C-40 623); Ser. No. 985,068 (Attorney Docket No. C-40,624).

*Primary Examiner*—Morton Foelak

[57] ABSTRACT

Polybenzoxazole or polybenzothiazole polymer dopes are spun through a spinneret having an orifice density of more than 0.25 per $cm^2$ to form filaments. The filaments formed then pass through an air gap which has a gas flowing into it at a temperature of between about 5° C. to about 100° C. and at a flow rate between about 0.1 meters/second and about 2.0 meters/second. The filaments cool in the air gap and are then coagulated. During or after coagulation the filaments are combined into one or more fibers. By this method of controlling the temperature in the air gap it is possible to stably spin polybenzoxazole or polybenzothiazole fibers at relatively high final line speeds.

7 Claims, No Drawings

METHOD FOR STABLE RAPID SPINNING OF A POLYBENZOXAZOLE OR POLYBENZOTHIAZOLE FIBER

CROSS-REFERENCE TO RELATED APPLICATIONS

This is a continuation-in-part of application Ser. No. 07/985,078 filed Dec. 3, 1992 now U.S. Pat. No. 5,294,390.

BACKGROUND OF THE INVENTION

The present invention relates to improved processes for spinning polybenzoxazole ("PBO") or polybenzothiazole ("PBT") fibers.

Lyotropic liquid-crystalline PBO and PBT are not thermoplastic. They are typically made into fibers by dry-jet, wet-spinning techniques, in which a dope that contains PBO or PBT polymer and an acid solvent is extruded through a spinneret, drawn across an air gap, and coagulated by contact with a fluid that dilutes the solvent and is a non-solvent for the polymer. The individual filaments formed by this process can be combined to form one or more fibers of varying size.

It is desirable to spin a large number of filaments for a long period of time at a high rate of speed. It is also desirable to produce a fiber containing many continuous filaments of a given cross-sectional area rather than producing a fiber containing fewer filaments of substantially larger individual cross-sectional area. However, thinner filaments are much more difficult to produce continuously because they have a greater tendency to break during spinning. It is desirable to provide a method which minimizes the number of filament breaks.

SUMMARY OF THE INVENTION

In one aspect, the present invention is a process for making one or more multi-filament polybenzoxazole or polybenzothiazole fiber(s), said process comprising the steps of:

(a) spinning a polybenzoxazole or polybenzothiazole dope at a temperature of at least 100° C. through a plurality of orifices in a spinneret, the density of orifices of the spinneret being at least 0.25 per $cm^2$ to form a plurality of dope filaments;

(b) drawing the dope filaments to reach a certain final line speed across an air gap that contains a gas at a temperature between about 5° C. and about 100° C. wherein said gas flows through the air gap at a rate sufficient such that the filaments are exposed to a similar surrounding gas temperature;

(c) contacting the drawn dope filaments with a fluid to remove solvent from the filaments; and (d) combining the filaments into one or more fibers during or after step (c).

Additional aspects of this invention are the process of the first aspect further comprising:

decreasing the gas temperature as the number of orifices in the spinneret increases, decreasing the gas temperature as the final line speed of the filaments increases; and increasing the gas flow rate as the number of filaments is increased.

DETAILED DESCRIPTION OF THE INVENTION

For purposes of this application, the term polybenzazole ("PBZ") includes polybenzoxazole ("PBO") homopolymers, polybenzothiazole ("PBT") homopolymers and random, sequential and block copolymers of PBO and/or PBT. The term polybenzazole does not include polybenzimidazole ("PBI") polymers or copolymers. PBO, PBT and random, sequential and block copolymers of PBO and PBT are described in references such as Wolfe et al., *Liquid Crystalline Polymer Compositions, Process and Products,* U.S. Pat. No. 4,703,103 (Oct. 27, 1987); Wolfe et al., *Liquid Crystalline Polymer Compositions, Process and Products,* U.S. Pat. No. 4,533,692 (Aug. 6, 1985); Wolfe et al., *Liquid Crystalline Poly(2,6-Benzothiazole) Compositions, Process and Products,* U.S. Pat. No. 4,533,724 (Aug. 6, 1985); Wolfe, *Liquid Crystalline Polymer Compositions, Process and Products,* U.S. Pat. No. 4,533,693 (Aug. 6, 1985); Evers, *Thermoxidatively Stable Articulated p-Benzobisoxazole and p-Benzobisthiazole Polymers,* U.S. Pat. No. 4,359,567 (Nov. 16, 1982); Tsai et al., *Method for Making Heterocyclic Block Copolymer,* U.S. Pat. No. 4,578,432 (Mar. 25, 1986) which are incorporated herein by reference; and in 11 Ency. Poly. Sci. & Eng., *Polybenzothiazoles and Polybenzoxazoles,* 601 (J. Wiley & Sons 1988) and W. W. Adams et al., *The Materials Science and Engineering of Rigid-Rod Polymers* (Materials Research Society 1989).

Units within the PBZ polymer are preferably chosen so that the polymer dope is lyotropic liquid-crystalline at fiber processing conditions. Preferred monomer units are illustrated in Formulae (a)–(h). The polymer more preferably consists essentially of monomer units selected from those illustrated in (a)–(h), and most preferably consists essentially of a number of identical units selected from those illustrated in (a)–(d).

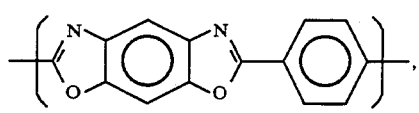
(a)

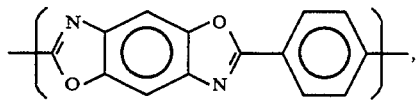
(b)

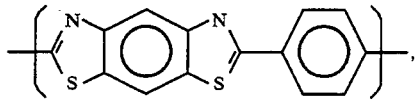
(c)

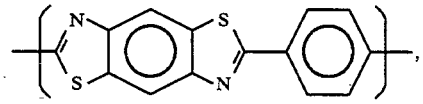
(d)

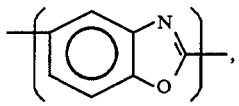
(e)

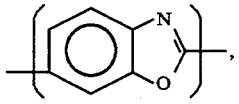
(f)

-continued (g)

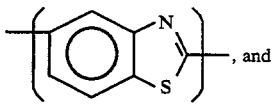

, and (h)

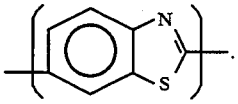

A "dope" of PBZ polymer is a solution of PBZ polymer in a solvent for the polymer. Solvents that can be used to form dopes of PBZ polymers include cresol as well as non-oxidizing acids capable of dissolving the polymer. Representative examples of acid solvents include polyphosphoric acid, methanesulfonic acid and highly concentrated sulfuric acid and mixtures of those acids. A preferred solvent is polyphosphoric acid or methanesulfonic acid. Most preferably, the solvent is polyphosphoric acid.

The concentration of the polymer in the solvent is preferably at least about 7 weight percent, more preferably at least about 10 weight percent and most preferably at least about 14 weight percent. The maximum concentration is limited primarily by practical factors, such as polymer solubility and dope viscosity. Because of these limiting factors the concentration of polymer is seldom more than about 30 weight percent, and usually no more than about 20 weight percent.

Suitable polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); and Harris, U.S. Pat. No. 4,847,350 (Jul. 11, 1989) which are incorporated herein by reference. Polybenzazole polymers can be advanced rapidly to high molecular weight at relatively high temperatures and high shear in a dehydrating acid solvent, according to Gregory, U.S. Pat. No. 5,089,591 (Feb. 18, 1992), which is incorporated herein by reference.

Spinning Fibers From PBZ Dopes

In order to accomplish efficient spinning, the dope should be homogeneous and substantially free of gas bubbles and solid particulates. This can be accomplished by implementation of known shear-filtration media (including the use of silica sand, metal filings and particulates, glass beads, sintered ceramics, sintered porous metal plates, and shaped structures and metal screens ); or known homogenizing equipment including single- and multiple-screw extruders, static mixers and other mixing devices.

The dope is extruded from a spinneret that contains a plurality of orifices. The orifices may be in any desired arrangement on the spinneret. Two typical arrangements are a lattice (defined as "a regular geometrical arrangement of points or objects over an area or in space") or a circular (also known as an "annular") pattern.

The density of orifices in the spinneret is the number of orifices per "active area" on the exit face of the spinneret. The "active area" of the spinneret is defined here as that minimum continuous area on the exit face of the spinneret which contains all of the orifices. The "active area" can also be defined as the total area on the exit face of the spinneret minus the "non-active area" which is the maximum continuous area that contains no orifices. An example of the measurement of the active and non-active areas is: for a spinneret where the orifices are arranged in an annular pattern, the active area on the exit face of the spinneret is the total area of the spinneret minus the area encompassed by the innermost ring of orifices (in which area there are no orifices) and the area outside the outermost ring of orifices. The non-active area in the same spinneret is the total area on the exit face of the spinneret minus the area occupied by all of the ring(s) of orifices. The orifice density is preferably at least about 0.25 per $cm^2$, more preferably at least about 0.5 per $cm^2$, more highly preferably at least about 1.0 per $cm^2$, most preferably at least about 2.0 per $cm^2$, and most highly preferably at least about 3.0 per $cm^2$.

For spinning filaments through small orifices using relatively low spin-draw ratios (the spin-draw ratio is the ratio of the final line speed of the filaments/fibers divided by the mass-calculated extrusion speed of the dope) the diameter of the orifice at the point where the dope leaves the spinneret on the exit face is usually at least about 0.05 millimeters in diameter, preferably at least about 0.08 millimeters, more preferably at least about 0.12 millimeters and most preferably at least about 0.15 millimeters. In this process, the diameter of an orifice is preferably no more than about 0.5 millimeters, more preferably no more than about 0.4 millimeters, and most preferably no more than about 0.35 millimeters. For spinning filaments through large orifices using relatively high spin-draw ratios, the average diameter of the orifice at the point where the dope leaves the spinneret is preferably at least about 0.5 millimeters in diameter, more preferably at least about 1 millimeter in diameter and most preferably at least about 1.5 millimeters in diameter.

The dope is extruded through the spinneret at a temperature of at least 100° C. The temperature is preferably at least about 120° C. and more preferably at least about 140° C. The maximum temperature is limited by the stability of the dope. It is preferably no more than about 220° C. and more preferably no more than about 200° C.

The optimum rate at which dope passes through the spinneret to form individual filaments varies depending upon the polymer concentration of the dope, the number of orifices, the desired final filament diameter, and the final filament line speed. Individual dope filaments leave each orifice and enter a gap between the spinneret and the coagulation zone (the coagulation zone is where the solvent is removed). The gap is typically called an "air gap" although it need not contain air. The air gap may contain any gas that does not induce coagulation or react adversely with the dope, such as air, nitrogen, argon, helium or carbon dioxide. Prior to entering the air gap there usually is a short distance where the filaments are not exposed to any directed gas flow (as they are within the air gap). This distance (commonly referred to as "collar length" or the "Spinneret to Quench Chamber Distance") is usually no more than about 10 centimeters and preferably no more than about 5 centimeters. It has been found that as the number of filaments increases it is desirable to shorten the collar length to less than 5 centimeters, and preferably to less than 4 centimeters in order to contact the dope filaments with directed gas flow as soon as possible.

In the air gap, the dope filaments are drawn to a spin-draw ratio that is preferably at least about 10, more preferably at least about 20, and most preferably at least about 40. The maximum spin-draw ratio for these dope filaments is preferably no more than about 500, more preferably no more than about 300 and most preferably no more than about 150. The length of the air gap is usually at least about 1 centimeter and at most about 100 centimeters, although longer and shorter air gaps may be used. Due to the spin draw ratio being greater than 1, the filaments travel through the air gap at a steadily increasing speed. The final line speed of the filaments is defined as the speed of the filaments as they enter the coagulation zone. Final line speeds are at least about 50 meters/minute, preferably at least about 75 meters/minute, more preferably at least about 100 meters/minute and most preferably at least about 200 meters/minute. Line speeds of 400 meters/minute or even 600 meters/minute can be achieved under optimal conditions.

A flow of gas is directed at the filaments in the air gap. This flow of gas serves to uniformly cool the filaments before they are contacted with a coagulating/washing fluid. It is theorized, without intending to be bound thereby, that in the absence of forced gas flow across the filaments, when a large number of polybenzazole filaments are spun close together at a high temperature, the outer filaments cool faster than the inner filaments. When the filaments undergo different cooling rates, it has been found to negatively affect spinning stability as evidenced by an increase in the number of filament breaks. The gas flow in the air gap acts such that all of the filaments experience a similar surrounding gas temperature. As the similar surrounding gas temperature is cooler than the temperature of the filaments, the filaments are cooled more uniformly as they pass through the air gap.

The temperature of the gas as it enters the air gap is at least about 5° C. and at most about 100° C. The temperature of the incoming gas should be adjusted as the number of filaments in the air gap changes. Higher temperatures are used for less filaments and lower temperatures are used for more filaments. It has also been found that the temperature of the incoming gas should be adjusted as the final line speed of the filaments changes. It has been found that as the final line speed of the filaments increases, the temperature of the incoming gas should be decreased. This decrease in gas temperature for an increase in either the number of filaments or the final line speed of the filaments allows for adequate heat removal within the air gap. The relationship between gas temperature, number of filaments and final line speed is exemplified as follows. At a final line speed of about 200 meters/minute a gas temperature of about 50° C. is appropriate for spinning about 330 filaments. At a final line speed of about 600 meters/minute the same gas temperature (about 50° C.) is appropriate for spinning about 100 filaments.

The cooling gas coming into the air gap preferably has an inlet flow rate sufficient such that the filaments are exposed to a similar surrounding gas temperature. The rate of gas flow into the air gap should preferably be between about 0.1 meters/second and 2.0 meters/second. As with the temperature of the incoming gas it has been found that the flow rate of the incoming gas preferably should be adjusted as the number of filaments in the air gap changes. The relationship between number of filaments and gas flow rate is such that as the number of filaments increases, so should the gas flow rate. The gas flow is preferably perpendicular to the direction in which the filaments move through the air gap. The gas flow into the air gap and continuing on through the bundle of filaments can be facilitated by providing a means for enhancing the exit flow rate of gas from the air gap through any suitable means for doing this, such as by using a suction device.

In order to ensure that all of the filaments in the air gap experience as close as possible to the same cooling profile due to exposure to the directed gas flow, it is usually necessary to enclose the air gap using a suitable device such as a quench chamber. The quench chamber or other device acts to isolate the filaments from the outside atmosphere. The presence of the quench chamber facilitates the directed gas flow contacting the filaments without dissipating. The quench chamber can be constructed out of any sufficiently gas impermeable barrier material such that it can contain the gas flow. The inlet gas flow is usually directed at the filaments through a means to spread out the gas flow so that the gas uniformly contacts the filaments. This means to spread out the gas flow can be a series of screens or sintered porous plates or anything that functions similarly.

Post-Air Gap Processing Of Filaments

After the dope filaments have been drawn, they are contacted with a fluid that dilutes the solvent and is a non-solvent for the polybenzazole polymer. The process of separating the solvent from the polymer is usually described as coagulation. After the majority of the solvent has been separated, the filaments are washed to remove residual solvent. The coagulation/washing fluid may be a gas, such as steam, but it is preferably a liquid and more preferably an aqueous liquid. The fiber may be contacted with fluid in a bath or spray form. The bath may be in many different forms, such as the baths described in Japan Open Laid Patent No. 63-12710; Japan Open Laid Patent No. 51-35716; or Japan Published Patent No. 44-22204, which are incorporated herein by reference. For details on optimum coagulation/washing techniques see U.S. Pat. No. 5,273,703 and U.S. patent application Ser. No. 154,237, filed Nov. 18, 1993 which are both entitled "Improved Process for Post-Spin Finishing of Polybenzoxazole Fibers" and are incorporated herein by reference.

Two or more filaments are combined into one or more fibers of varying sizes to produce a multi-filament fiber as opposed to a monofilament fiber. This combination step usually takes place during or after the coagulation/washing process.

The coagulated and washed fiber may be collected and dried by known methods. See pending U.S. patent application Ser. No. 142,526, filed Nov. 2, 1993, entitled "Method For Rapid Drying of a Polybenzazole Fiber" for details on optimum drying techniques. The fiber may be heat-treated to increase tensile modulus if desired. See pending U.S. patent application Ser. No. 162,724, filed Dec. 3, 1993, entitled "Improved Process for Post-Spin Finishing of Polybenzoxazole Fibers," for details on optimum drying and heat-treating. Both of these patent applications are incorporated herein by reference.

The resulting multi-filament fiber is made up of individual filaments which have an average individual diameter of no more than about 21 μm (0.83 mils), preferably no more than about 19 μm (0.75 mils), more preferably no more than about 15 μm (0.59 mils) and most preferably no more than about 12 μm (0.30 mils). "Denier" is the weight in grams of 9000 meters of any fiber. In this invention the denier-per-filament ("dpf") is no more than about 5, more preferably no more than about 2.5, and most preferably no more than about 1.5.

The present invention improves the stability of spinning simultaneously a large number of closely spaced filaments. It makes it possible to stably spin while minimizing line breaks. It has the additional benefits of reducing denier variation between different individual filaments.

EXAMPLES

The following examples are for illustrative purposes only. They should not be taken as limiting the scope of either the specification or claims. Unless stated otherwise, all parts and percentages are by weight.

Measurement Of Inherent Viscosity Of PBZ Dopes

Measurements of solution viscosity of these PBO and PBT dopes are usually made by comparing the efflux time, t, required for a specified volume of polymer solution to flow through a capillary tube with the corresponding efflux time, to, for the solvent. These capillary tubes can be any of those standard capillary viscometers known in the art such as Ostwald-Fenske or Ubbelohde. From t, $t_o$, and the solute concentration, the inherent viscosity or "IV" of the dope is derived as follows.

Inherent Viscosity $=\eta_{inh}=\ln(\eta_{rel}/c)$ $\eta_{rel}$ = the relative viscosity $=t/t_o$ is the ratio of the outflow time for the solution (t) to the outflow time for the pure solvent ($t_o$), c = concentration of polymer in solution, given in grams per deciliter. The units for inherent viscosity are deciliters per gram.

The values required to calculate inherent viscosity are dependent upon the concentration of the polymer in the solvent, the temperature of the solutions as they are measured and the solvent used in the solutions. Therefore, any inherent viscosity numbers given must specify these factors.

In all of these examples the inherent viscosity (IV) of the polymer solution is measured at 25° C., at a concentration of about 0.05 g/dL and in a solvent made up of: methanesulfonic acid ("MSA") saturated with methanesulfonic acid anhydride ("MSAA") (3 parts MSA to 1 part MSAA) with sodium methane sulfonate ("SMS") added to this mixture until the concentration of SMS in the solution is 0.1 molar.

Gas Flow

In all of these Examples, the gas flow into the air gap is air.

Example 1—Spinning of 42 PBO Filaments

A polymer solution of 14 weight percent cis-PBO (with an inherent viscosity or "IV" of 30) in polyphosphoric acid is extruded from the spinneret (wherein the orifices are arranged in a lattice pattern) at 170° C. under the conditions shown in Table 1. The extruded filaments are combined into one fiber and coagulated in water at about 10° C. The resulting fiber is washed as it travels around multiple pairs of rollers. The fiber is collected wet, washed further and dried off-line. Table 1 describes the observations of spinning and the resulting fiber physical properties. The conditions reported in the table indicate combinations of processing conditions where it is possible to stably spin fiber at relatively high line speeds with excellent spinnability. Table 1 refers to tenacity (tensile strength) in terms of grams per denier ("g/d"). For PBO fiber, one gram per denier is approximately equivalent to 20 Ksi. One Ksi is equivalent to 0.006894 GPa (giga pascals). One Msi is equivalent to 6.894 GPa.

TABLE 1

| | unit | Experimental # 1A |
|---|---|---|
| SPINNING SPECIFICATIONS/PROPERTIES | | |
| Spinneret Active Area | $cm^2$ | 7.3 |
| No. of Orifices | | 42 |
| Orifice Density | $\#/cm^2$ | 5.8 |
| Spinneret Hole Throughput | mL/min | 0.12 |
| Orifice Diameter | mm | 0.22 |
| Spinneret to Quench Chamber Distance | cm | 4 |
| Length of Quench Chamber | cm | 15 |
| Quench Air Velocity | m/sec | 0.25 |
| Quench Air Temperature | °C. | 90 |
| Spinneret to Coagulation Bath Distance | cm | 35 |
| Final Line Speed | m/min | 200 |
| Spin Draw Ratio | | 63 |
| Spinnability | | Excellent |
| FIBER PROPERTIES | | |
| Denier | | 63 |
| Denier per Filament | dpf | 1.5 |
| Tenacity | g/d | 44 |
| Tensile Modulus | g/d | 1424 |
| Elongation at Break | % | 3.2 |

Example 2—Spinning of 100 PBO Filaments

A polymer solution of 14 weight percent cis-PBO (30 IV) in polyphosphoric acid is extruded through the spinneret (orifices in lattice pattern) at 170° C. under the conditions shown in Table 2. The extruded filaments are combined into one fiber and coagulated in a 10 percent phosphoric acid/water solution at about 10° C. The resulting fiber is washed as it travels around multiple pairs of rollers. The fiber is collected wet, washed further and dried off-line. Table 2 describes the observations of spinning and the resulting fiber physical properties. Table 2 indicates combinations of processing conditions wherein it is possible to stably spin fiber at relatively high line speeds.

TABLE 2

| | unit | Experimental # 2A | 2B | 2C |
|---|---|---|---|---|
| SPINNING SPECIFICATIONS/PROPERTIES | | | | |
| Spinneret Active Area | $cm^2$ | 35.4 | 35.4 | 35.4 |
| No. of Orifices | | 100 | 100 | 100 |
| Orifice Density | $\#/cm^2$ | 2.8 | 2.8 | 2.8 |
| Spinneret Hole Throughput | mL/min | 0.12 | 0.24 | 0.36 |
| Orifice Diameter | mm | 0.22 | 0.22 | 0.22 |
| Spinneret to Quench Chamber Distance | cm | 4 | 4 | 4 |
| Length of Quench Chamber | cm | 20 | 30 | 30 |
| Quench Air Velocity | m/sec | 0.5 | 0.5 | 0.5 |
| Quench Air Temperature | °C. | 70 | 60 | 50 |
| Spinneret to Coagulation Bath Distance | cm | 50 | 50 | 50 |
| Final Line Speed | m/min | 200 | 400 | 600 |

TABLE 2-continued

| | unit | Experimental # 2A | 2B | 2C |
|---|---|---|---|---|
| Spin Draw Ratio | | 63 | 63 | 63 |
| Spinnability | | Excellent | Excellent | Excellent |
| FIBER PROPERTIES | | | | |
| Denier | | 150 | 150 | 150 |
| Denier per Filament | dpf | 1.5 | 1.5 | 1.5 |
| Tenacity | g/d | 41 | 41 | 41 |
| Tensile Modulus | g/d | 1224 | 1244 | 1215 |
| Elongation at Break | % | 3.8 | 3.8 | 3.7 |

Example 3—Spinning of 166 PBO Filaments

A polymer solution of 14 weight percent of cis-PBO (30 IV) in polyphosphoric acid is extruded through the spinneret (orifices arranged in lattice pattern) at 170° C. under the conditions shown in Table 3. The extruded filaments are combined into one fiber and coagulated in a 10 percent phosphoric acid/water solution at about 10° C. The resulting fiber is washed as it travels around multiple pairs of rollers. The fiber is collected wet, washed further and dried off-line. Table 3 describes the observations of spinning and the resulting fiber physical properties. Table 3 indicates combinations of processing conditions where it is possible to stably spin fiber at relatively high line speeds.

TABLE 3

| | unit | Experimental # 3A | 3B | 3C |
|---|---|---|---|---|
| SPINNING SPECIFICATIONS/PROPERTIES | | | | |
| Spinneret Active Area | $cm^2$ | 35.4 | 35.4 | 35.4 |
| No. of Orifices | | 166 | 166 | 166 |
| Orifice Density | $\#/cm^2$ | 4.7 | 4.7 | 4.7 |
| Spinneret Hole Throughput | mL/min | 0.12 | 0.18 | 0.24 |
| Orifice Diameter | mm | 0.22 | 0.22 | 0.22 |
| Spinneret to Quench Chamber Distance | cm | 4 | 4 | 4 |
| Length of Quench Chamber | cm | 20 | 30 | 30 |
| Quench Air Velocity | m/sec | 0.5 | 0.5 | 0.5 |
| Quench Air Temperature | °C. | 70 | 60 | 50 |
| Spinneret to Coagulation Bath Distance | cm | 45 | 45 | 45 |
| | | 2A | 2B | 2C |
| Final Line Speed | m/min | 200 | 300 | 400 |
| Spin Draw Ratio | | 63 | 63 | 63 |
| Spinnability | | Excellent | Excellent | Excellent |
| FIBER PROPERTIES | | | | |
| Denier | | 250 | 250 | 250 |
| Denier per Filament | dpf | 1.5 | 1.5 | 1.5 |
| Tenacity | g/d | 41 | 41 | 41 |
| Tensile Modulus | g/d | 1155 | 1162 | 1162 |
| Elongation at Break | % | 3.8 | 3.8 | 3.8 |

Example 4—Spinning of 332 PBO Filaments

A polymer solution of 14 weight percent cis-PBO (30 IV) in polyphosphoric acid is extruded through the spinneret (orifices arranged in lattice pattern) at 170° C. under the conditions shown in Table 4. The extruded filaments are combined into one fiber and coagulated in a 10 percent phosphoric acid/water solution at about 10° C. The resulting fiber is washed as it travels around multiple pairs of rollers. The fiber is collected wet, washed further and dried off-line. Table 4 describes the observations of spinning and the resulting fiber physical properties. Table 4 indicates combinations of processing conditions where it is possible to stably spin fiber at relatively high line speeds.

TABLE 4

| | unit | Experimental # 4A |
|---|---|---|
| SPINNING SPECIFICATIONS/PROPERTIES | | |
| Spinneret Active Area | $cm^2$ | 39.6 |
| No. of Orifices | | 332 |
| Orifice Density | $\#/cm^2$ | 8.4 |
| Spinneret Hole Throughput | mL/min | 0.12 |
| Orifice Diameter | mm | 0.18 |
| Spinneret to Quench Chamber Distance | cm | 2 |
| Length of Quench Chamber | cm | 30 |
| Quench Air Velocity | m/sec | 1.0 |
| Quench Air Temperature | °C. | 50 |
| Spinneret to Coagulation Bath Distance | cm | 45 |
| Final Line Speed | m/min | 200 |
| Spin Draw Ratio | | 42 |
| Spinnability | | Excellent |
| FIBER PROPERTIES | | |
| Denier | | 500 |
| Denier per Filament | dpf | 1.5 |
| Tenacity | g/d | 40 |
| Tensile Modulus | g/d | 1120 |
| Elongation at Break | % | 3.7 |

Example 5—Spinning of 340 PBO Filaments

A polymer solution of 14 weight percent cis-PBO (30 IV) in polyphosphoric acid is extruded through the spinneret (orifices arranged in annular pattern) at 155° C. under the conditions shown in Table 5. The extruded filaments are coagulated in water at about 10° C. to 20° C. The resulting fiber is washed as it travels around multiple pairs of rollers. The fiber is collected wet, washed further and dried off-line. Table 5 describes the observations of spinning and the resulting fiber physical properties. Table 5 indicates combinations of processing conditions where it is possible to stably spin fiber at relatively high line speeds.

TABLE 5

| | unit | Experimental # 5A |
|---|---|---|
| SPINNING SPECIFICATIONS/PROPERTIES | | |
| Spinneret Active Area | $cm^2$ | 47.3 |
| No. of Orifices | | 340 |
| Orifice Density | $\#/cm^2$ | 7.2 |
| Spinneret Hole Throughput | mL/min | 0.04 |
| Orifice Diameter | mm | 0.16 |
| Spinneret to Quench Chamber Distance | cm | 3 |
| Length of Quench Chamber | cm | 10 |
| Quench Air Velocity | m/sec | 0.8 |
| Quench Air Temperature | °C. | 17 |
| Spinneret to Coagulation Bath Distance | cm | 30 |
| Final Line Speed | m/min | 72 |
| Spin Draw Ratio | | 33 |
| Spinnability | | Excellent |
| FIBER PROPERTIES | | |
| Denier | | 500 |
| Denier per Filament | dpf | 1.5 |
| Tenacity | g/d | 38 |
| Tensile Modulus | g/d | 1078 |
| Elongation at Break | % | 3.5 |

What is claimed is:

1. A process for making one or more multi-filament polybenzoxazole or polybenzothiazole fiber(s), said process comprising the steps of:

(a) extruding a polybenzoxazole or polybenzothiazole dope at a temperature of at least 100° C. through a plurality of orifices in a spinneret, the density of orifices of the spinneret being at least 0.25 per $cm^2$ to form a plurality of dope filaments;

(b) drawing the dope filaments to reach a certain final line speed across an air gap that contains a gas at a temperature between about 5° C. and about 100° C., wherein the gas flows through the air gap at a rate sufficient such that the filaments are exposed to a similar surrounding gas temperature; and (c) contacting the drawn dope filaments with a fluid to remove solvent from the filaments; and (d) combining the filaments into one or more fibers during or after step (c).

2. The process of claim 1, further comprising decreasing the gas temperature as the number of said orifices in the spinneret increases.

3. The process of claim 1, further comprising decreasing the gas temperature as the final line speed of said filaments increases.

4. The process of claim 1, further comprising increasing the gas flow rate as the number of said filaments is increased.

5. The process of claim 1 in which the rate the gas flows through the air gap is between about 0.1 meters/-second and about 2.0 meters/second.

6. The process of claim 1 in which the final line speed of the filaments is about 200 meters/minute, the incoming gas temperature is about 50° C., and the number of orifices in the spinneret is about 330.

7. The process of claim 1 in which the final line speed of the filaments is about 600 meters/minute, the incoming gas temperature as about 50° C., and the number of orifices in the spinneret is about 100 filaments.

* * * * *